United States Patent [19]

Schmednecht

[11] 4,249,836

[45] Feb. 10, 1981

[54] METHOD AND APPARATUS FOR BUILDING BELOW GROUND SLURRY WALLS

[75] Inventor: Fred C. Schmednecht, Mount Prospect, Ill.

[73] Assignee: Slurry Systems, Inc., Gary, Ind.

[21] Appl. No.: 710,640

[22] Filed: Aug. 2, 1976

[51] Int. Cl.[3] ..... E02D 5/18; E02D 29/00

[52] U.S. Cl. ..... 405/267; 405/240; 405/248

[58] Field of Search ..... 61/35, 53.64, 53.66, 61/63; 405/240, 267, 269, 248

[56] References Cited

U.S. PATENT DOCUMENTS

| | | | |
|---|---|---|---|
| 3,645,101 | 2/1972 | Sherard | 61/35 |
| 3,969,902 | 7/1976 | Ichise et al. | 61/35 |
| 3,973,408 | 8/1976 | Paverman | 61/35 |

FOREIGN PATENT DOCUMENTS

| | | | |
|---|---|---|---|
| 1469001 | 1/1967 | France | 61/35 |
| 959660 | 6/1964 | United Kingdom | 405/267 |

*Primary Examiner*—David H. Corbin

*Attorney, Agent, or Firm*—Leydig, Voit, Osann, Mayer & Holt, Ltd.

[57] ABSTRACT

A method and apparatus for building below ground slurry walls utilizing a single vibratory beam for making successive overlapping insertions into and extractions out of the ground with a rearwardly projecting fin adjacent the lower end of the beam for penetrating substantially into the web of slurry material left in the ground after the previous insertion and extraction and a nozzle for injecting slurry material beneath the fin as the beam is extracted. Adjustable plumbing and stabilizing means are also provided.

15 Claims, 12 Drawing Figures

METHOD AND APPARATUS FOR BUILDING BELOW GROUND SLURRY WALLS

The present invention relates generally to a method and apparatus for constructing below ground slurry walls and more particularly concerns a method and apparatus utilizing a single vibratory beam for constructing such walls.

In many instances it is necessary or desirable to construct a below ground barrier wall to isolate and protect a job site or the like from surrounding ground water seepage. In other cases such an impervious barrier wall is needed to surround water retention basins or reservoirs to keep the water in.

For some time it has been common practice to build such barrier walls by first digging a trench to the desired depth and then filling the trench with barrier material such as a slurry formed of pulverized bentonite and cement suspended in water. More recently, such walls have been constructed by driving a row of beams into the ground and then injecting the slurry material into the space below each beam as the beams are successively withdrawn from the row. Reference may be made, for example, to Gallup U.S. Pat. No. 3,245,222 and the patents cited therein.

It is the primary aim of the present invention to provide an improved method and apparatus for building below ground slurry walls utilizing a single vibratory beam for making successive overlapping insertions into and extractions out of the ground and which employs a novel beam configuration and slurry injection nozzle arrangement which insures the formation of a continuous slurry wall of substantially uniform thickness. The invention is further characterized in the use of a rearwardly projecting fin adjacent the lower end of the vibratory beam for penetrating substantially into the web of slurry material left in the ground after the previous insertion and extraction of the beam and by a nozzle for injecting slurry material beneath the fin as the beam is extracted. In the preferred embodiment, a separate jet nozzle is used to inject slurry material at high pressure during beam insertion and the beam is guided by rollers on a lead, the lower end of which is adjustably positioned prior to insertion and then stabilized during insertion and extraction of the vibratory beam.

These and other objects and advantages of the invention will become more readily apparent upon reading the following, detailed description and upon reference to the drawings in which.

While the invention will be described in connection with a preferred embodiment and procedure, it will be understood that I do not intend to limit the invention to what is shown and described. On the contrary, I intend to cover all alternatives, modifications and equivalents as may be properly included within the spirit and scope of the invention as defined by the appended claims.

Figures 1, 2, 3:
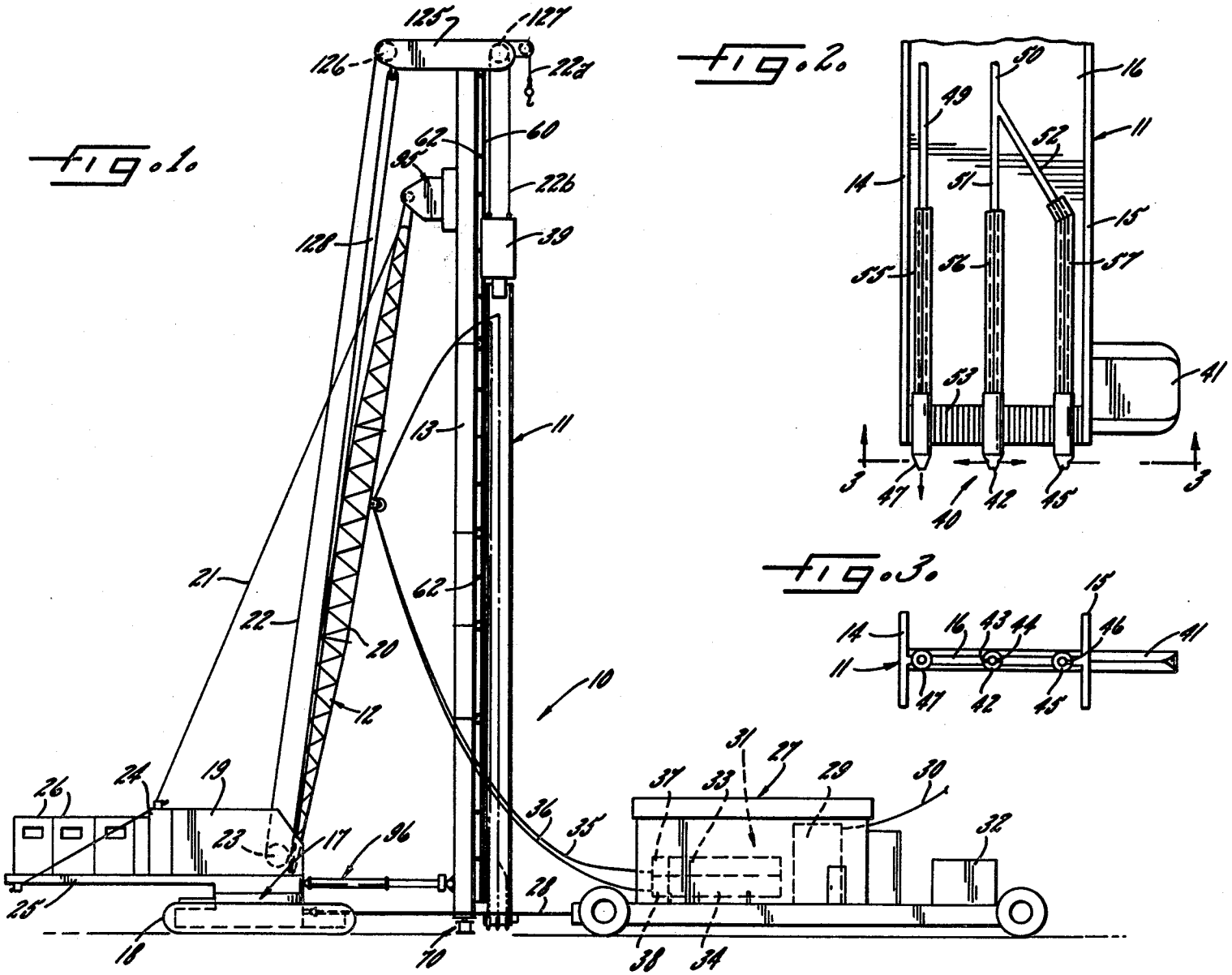
FIG. 1 is a side elevation of one form of the apparatus for constructing below ground slurry walls of the present invention.
FIG. 2 is an enlarged fragmentary side elevation of the lower end of the vibratory beam shown in FIG. 1.
FIG. 3 is an end view of the vibratory beam as seen substantially along line 3—3 in FIG. 2.

Turning now to the drawings, there is shown in FIG. 1 a preferred form of apparatus 10 for constructing below ground slurry walls of the present invention. The apparatus includes a vibratory beam 11 for making successive overlapping insertions into and extractions out of the ground along a predetermined line of travel. As seen in FIG. 1, the line of travel is from right to left. A lift crane 12 and guide lead 13 are provided for supporting and vertically aligning the beam 11 during successive insertions and extractions. As shown in FIGS. 2 and 3, the vibratory beam 11 is preferably a wide flange I-beam having front and rear flanges 14 and 15, respectively, interconnected by a central web 16. The crane 12 has lower works 17 supported on crawler tracks 18 and upper works 19 including a pivotally mounted boom 20, boom hoist mechanism 21 and a hoist line 22 wound on a hoist drum 23 selectively driven by the crane engine, not shown. The crane may also include an auxiliary hoist line **22*a* wound on another hoist drum (not shown) if desired. The crane upper works 19 also includes a counterweight 24 and a rear frame extension 25 for supporting a plurality of electric generator sets 26**.

In its preferred form, the apparatus 10 also includes a slurry supply trailer 27 drawn through links 28 by the crane 12 along the line of travel. The supply trailer 27 includes a slurry tank 29, which may be filled by a supply conduit 30 from a remote source, and pump means 31 driven for example, by a motor-generator set 32. The pump means 31 includes a high pressure pump 33 and a low pressure pump 34 for supplying slurry material to the vibratory beam 11 through flexible supply lines 35 and 36, respectively. Suitable valves and pressure regulating means 37 and 38 are interposed between the pumps 33, 34 and the supply lines 35, 36 for controlling the pressure and rate of slurry supply.

In accordance with the present invention, the beam 11 is driven into the ground by a vibratory unit 39 slidably mounted on the guide lead 13 and supported by the crane hoist line 22 which may advantageously be a multi-part line as shown at **22*b*. The vibratory unit 39 is preferably of the eccentric type, driven by electric motors (not shown) from current supplied from the generator sets 26 mounted on the rear of the crane 12. During operation, the beam 11 is vibrated in a substantially vertical direction by the unit 39 both during insertion into and extraction out of the ground. In addition to the vibration, which may be on the order of about 1000 cycles per minute, the weight of the beam 11 and the vibratory unit 39 force the beam into the ground. Extraction is accomplished by winding up the hoist line 22 on the drum 23 and is also facilitated by the continuous vibration of the beam 11**.

Pursuant to the invention, nozzle means 40 are provided for injecting slurry material into the ground beneath the beam 11 and a rigid fin 41 projecting rearwardly from the lower end of the beam. The fin 41 has a thickness substantially equal to the web 16 of the beam 11 which may be reinforced at its lower end, and extends rearwardly a distance equal to about half the distance between beam flanges. It will be seen however that the fin 41 is quite short vertically compared to the overall length of the beam which may be on the order of 50 to 75 feet long. During successive insertions, the fin 41 and rear flange 15 of the beam are positioned to overlap the space formerly occupied by the front flange 14 and a portion of the web 16 during the previous insertion. In the preferred embodiment, the nozzle means 40 includes a central supply nozzle 42 having front and rear discharge orifices 43 and 44 substantially aligned with the web 16 of the beam 11 and a lapping nozzle 45 having a discharge orifice 46 directed substantially under the fin 41. As the beam is extracted, slurry material is injected into the void in the ground beneath the beam 11 and fin 41. Without such a fin, the slurry material left below the web 16 on the previous extraction tends to neck down or thin out appreciably adjacent the rear flange 15 and for some distance rearwardly thereof apparently due to the vibrations imparted by the succeeding insertion and extraction of the beam 11.

In keeping with a further aspect of the invention, the nozzle means 40 includes a jet nozzle 47 having a downwardly directed orifice adjacent the front flange 14 of the beam 11. During insertion of the beam 11, slurry material is delivered to the jet nozzle 47 by the high pressure pump 33 through the flexible conduit 35 and a rigid conduit 49 to facilitate entry and lubrication of the beam in the ground. As noted above the discharge pressure of the high pressure pump means is selectively regulated by the valve 38, for example, in the range of 0–250 psi and, depending on soil conditions, may be set at an operating pressure of 120–150 psi during beam insertion. The supply nozzles 42 and 45 are supplied by the low pressure pump 34 through flexible conduit 36 and a common rigid conduit 50 which has terminal branches 51 and 52 welded to the web 16 of the beam 11. It will be understood that the discharge pressure through the supply nozzles 42 and 45 only need to be slightly positive to fill the void as the beam 11 and fin 41 are extracted, but that higher pressure may be employed if greater lateral penetration of slurry material into the ground is desired. In normal operation a shallow trench (not shown) is formed along the line of intended travel which serves as a surface reservoir of slurry material and provides a visual indication of whether or not sufficient slurry material is being injected into the ground, particularly during beam extraction.

To increase the working life of the beam 11, its lower end is preferably provided with hardened metal wear plates 53. Likewise, hardened metal is applied to the surfaces of the fin 41 and the nozzles 42, 45 and 47 are preferably formed of hard alloy steel. Additionally, metal wear shields 55, 56 and 57 are provided for the conduits 49, 51 and 52, respectively, and hardened metal may be applied to the outer surface of the shields 55–57 as shown at 58 to increase their wear resistance, if desired.

Figure 11:
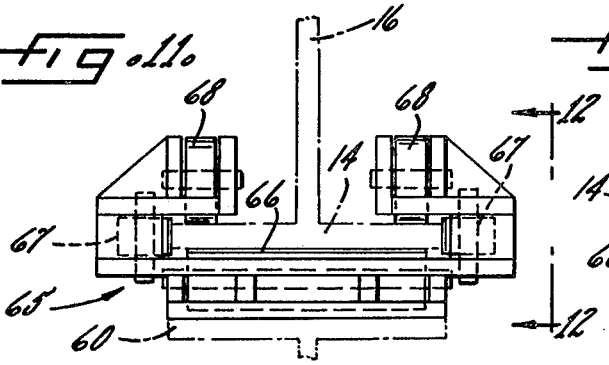
FIG. 11 is an enlarged fragmentary horizontal section through the vibratory beam showing the roller guide support at the lower end thereof; and, FIG. 12 is a fragmentary side elevation of the roller guide as seen substantially along line 12—12 in FIG. 11.
Figure 12:
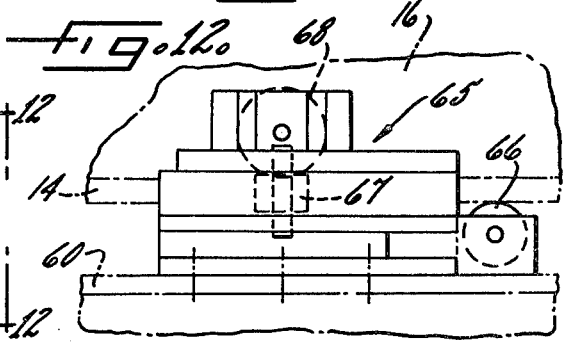

The guide lead 13 may be formed of large diameter pipe sections bolted together at their respective end flanges and a flat guide track 60 is attached to the rear side of the pipe sections such as by welded support plates 62. The vibratory unit 39 is slidably mounted on the guide track such as by a forwardly facing channel which receives the rear face of the track and laterally extending retaining plates (not shown) which overlap the front face of the track. In the preferred embodiment, the beam 11 is horizontally supported and guided by a roller assembly 65 secured to the track 60 at the lower end of the guide lead. As shown in FIGS. 11 and 12 the roller assembly 65 includes front, side and back rollers 66-68 which, respectively, engage the face, sides and back of the front flange 14 of the beam 11.

Figure 4:
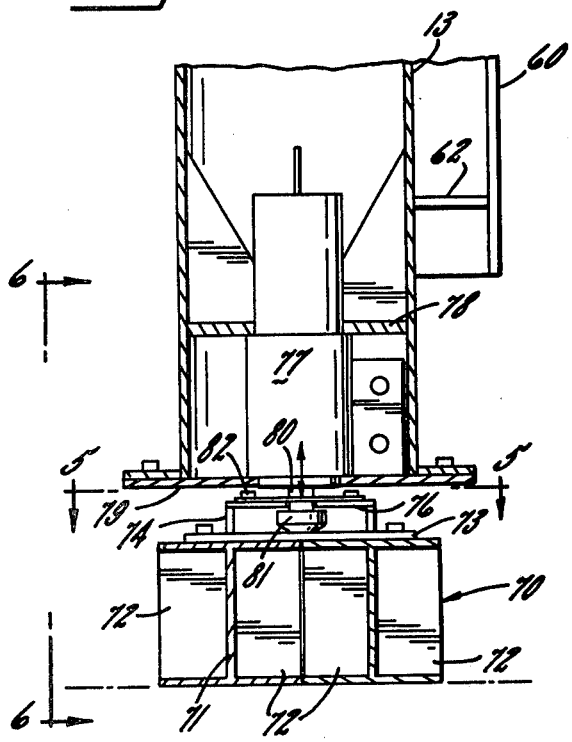
FIG. 4 is an enlarged fragmentary vertical section of the lower end of the guide lead and the stabilizing pad for the vibratory beam shown in FIG. 1.
Figure 5:
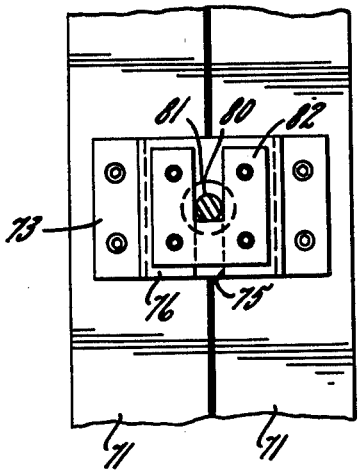
FIG. 5 is a horizontal section as seen substantially along line 5—5 in FIG. 4.
Figure 6:
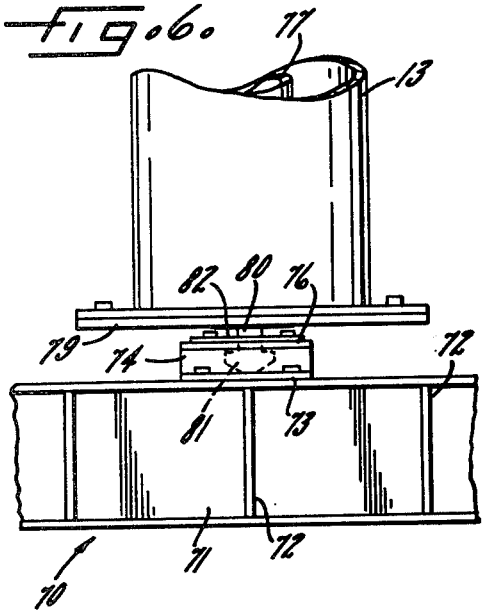
FIG. 6 is a fragmentary front elevation of the lower end of the guide lead and stabilizing pad as seen substantially along line 6—6 in FIG. 4.

To support the guide lead 13 during insertion and extraction of the beam 11, a transverse stabilizer pad 70 is provided. As shown in FIGS. 4–6, the pad 70 in the illustrated embodiment is formed of a pair of I-beams 71, the flanges of which are reinforced with additional web plates 72. It will be understood, however, that the pad 70 could also be formed of other materials such as railroad ties or reinforced concrete beams, for example. The beams 71 are bolted to an attachment frame 73 which has a hollow box section 74 with a partial slot 75 in the upper plate 76 thereof. A hydraulic jack cylinder 77 is retained in the lower end of the guide lead 13 between a cross plate 78 and an end plate 79 bolted to the lower flange of the lead. The piston rod 80 of the jack 77 is dimensioned to fit the slot 75 and has an enlarged end 81 which is retained in the box section 74 by a partially slotted retainer plate 82 bolted to the upper plate 77.

Figure 7:
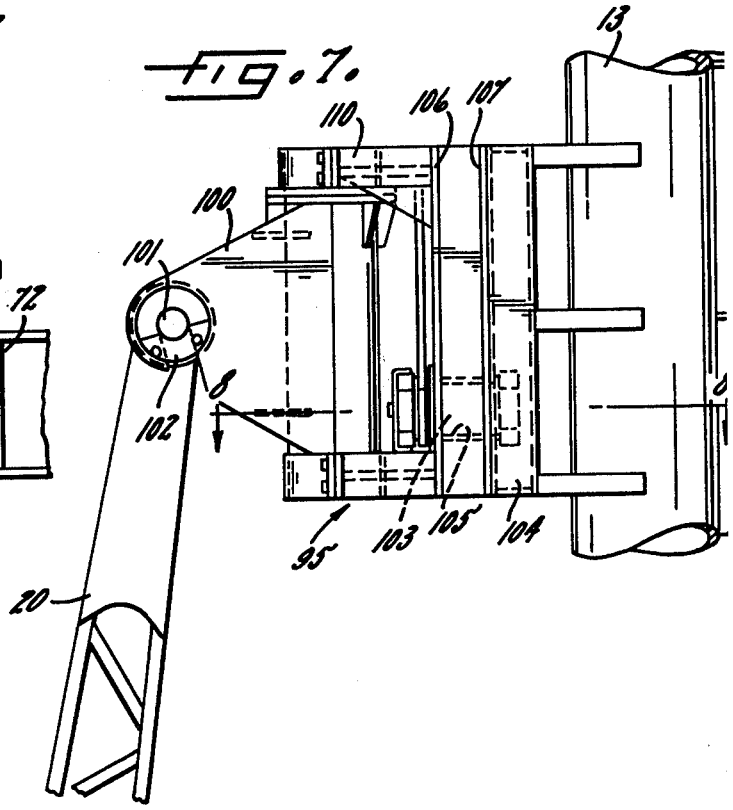
FIG. 7 is an enlarged fragmentary side elevation of the boom point and guide lead pivot bracket shown in FIG. 1.
Figure 8:
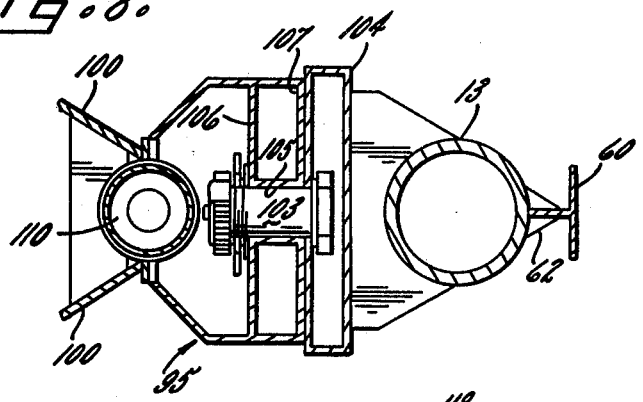
FIG. 8 is a horizontal section as seen substantially along line 8—8 in FIG. 7.

Before the beam 11 is inserted in the ground it is necessary to align, plumb and stabilize the lead 13 to insure that a straight, continuous vertical slurry wall is formed. To this end, the guide lead 13 is attached to the crane boom 20 by an upper pivot assembly 95 and to the crane frame by a longitudinally adjustable frame 96 and a laterally adjustable sub-frame 97. As shown in FIGS. 7 and 8 the upper pivot assembly includes a pair of slotted plates 100 which hook over a transverse pivot pin 101 at the boom tip. The side plates 100 are retained on the pivot pin 101 by arcuate plates 102 bolted to the side plates 100. It will be understood that the pivot pin 101 permits the lower end of the guide 13 and beam 11 to swing fore and aft along the line of travel as regulated by the adjustable frame 96.

Figure 9:
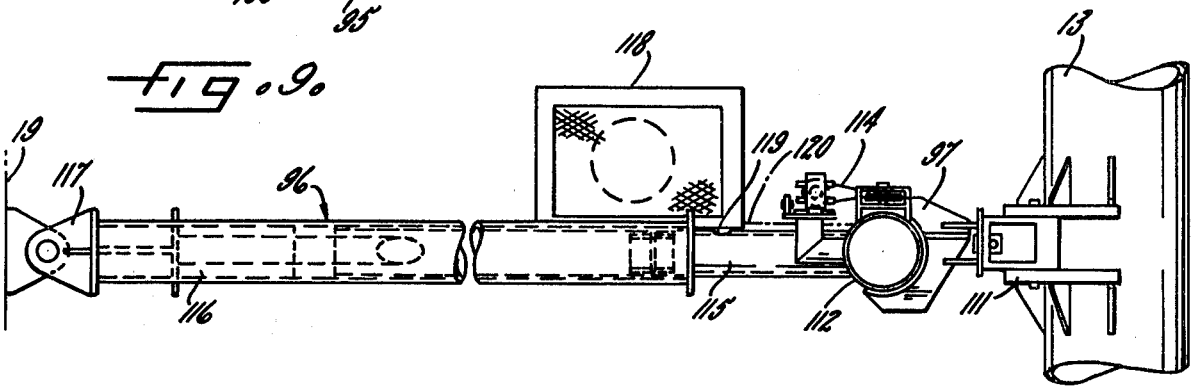
FIG. 9 is an enlarged fragmentary side elevation of the lower adjustable connecting frame for the apparatus shown in FIG. 1.
Figure 10:
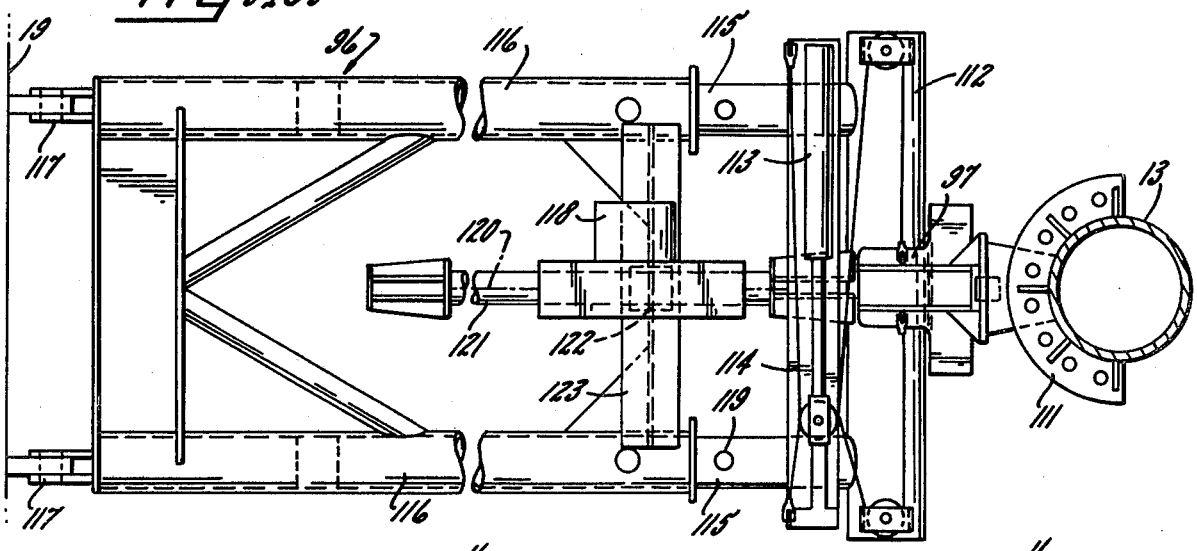
FIG. 10 is a top plan view of the adjusting frame shown in FIG. 9.

To permit lateral adjustment of the lower end of the guide 13 and beam 11, the upper pivot assembly 95 is also provided with a longitudinally extending pivot pin 103 which projects forwardly from a mounting bracket 104 welded to the guide lead 13 and through a sleeve 105 located between a pair of transverse support plates 106 and 107 connected to the side plates 100, such as by a vertical pivot assembly 110. As shown in FIGS. 9 and 10, a mounting bracket 111 adjacent the lower end of the guide lead 13 is secured to the sub-frame 97 which is slidably mounted on a transverse tube 112 of the adjustable frame 96. Means such as a hydraulic cylinder 113 and cable assembly 114 are provided for slidably moving the sub-frame 97 on the tube 112 and thus adjusting the lateral position of the lower end of the guide lead 13 and beam 11.

For swinging the lower end of the guide lead 13 and beam 11 fore and aft, the longitudinally adjustable frame 96 is preferably of telescopic construction having inner tubular frame members 115 slidably mounted within outer tubes 116 which are pivotally connected to the crane frame by suitable end brackets 117. To telescope the inner members 115 in and out of the outer tubes 116, an appropriate actuator 118 is employed. In the illustrated embodiment, the actuator 118 is a reversible hydraulic motor and sprocket 119 drive unit which drives a chain 120 fore and aft. The ends of the chain 120 are pinned on a center frame element 121 that extends forwardly from the transverse tube 112 and through a slide collar 122 on another transverse member 123 welded to the rear end of the outer tubes 116. As the sprocket 119 rotates clockwise (as seen in FIG. 9) the inner frame members 115 slide out of the tubes 116 and, conversely, counter-clockwise rotation of the sprocket causes retraction of members 115 within the tubes 116.

Referring back to FIG. 1, it will be seen that the beam 11 and vibrator 39 are guided by the track 60 such that they are off-set rearwardly of the center line of the pipe lead 13 by an appreciable amount. This, of course, produces eccentric bending moments along the length of the lead 13. To counteract these forces, the top of the lead is provided with a rearwardly extending leg 125 which supports front and rear sheaves 126 and 127 over which the hoist line 22 is reeved. Thus when the vibrator 39 and beam 11 are suspended or being raised by the hoist line 22 a countering moment is exerted on the top of the lead by the rearwardly extending leg 125. Additionally, a pair of fixed pendants 128 are connected to the rear end of the leg 125 and the crane frame to complete balancing of this unbalanced moment.

While the operation of the apparatus 10 of the present invention should now be readily apparent to one skilled in the art from the foregoing description, a brief summary of the preferred method of operation follows. After the site is prepared including leveling the surface along the line of travel of the apparatus and preferably the formation of a shallow trench above where the wall is to be formed, the apparatus 10 is moved into position, with the tracks straddling the trench, and the lower end of the beam positioned for the first insertion. If necessary, to correct for plumbness in the lateral direction due for example to uneven ground under the crane tracks the cylinder 113 is energized to slide the subframe 96 on the transverse tube 112 and thus shift the lateral position of the lower end of the lead 13 and beam 11. If this moves the end of the beam off the intended line of insertion, the crane may be rotated slightly about is turntable to bring the beam back into alignment. Similarly, the fore and aft positions of the lower end of the beam 11 and its longitudinal plumbness may be adjusted by operation of the motor 118 to telescope the frame members 115 in or out of the tubes 116.

Next the hydraulic jack 77 is extended causing the stabilizing pad 70 to engage the ground and thus support the guide lead 13, the vibrator 39 and the beam 11. It will be understood that the pad 70 is sufficiently long to span the trench (not shown) and to provide adequate bearing surface on either side thereof. If engagement of the stabilizing pad 70 with the ground causes the lead 13 to move out of longitudinal plumbness, the boom hoist 21 can be adjusted so as to move the top of the lead 13 fore or aft as required to restore longitudinal plumbness.

The hoist line 22 is payed out, the vibrator 39 is energized and the valve and regulator 37 for the high pressure pump are set for the initial insertion. As the vibrator 39 forces the beam into the ground, slurry material is injected from the jet nozzle 47 to clear dirt away from the beam end and to lubricate the beam 11 during insertion. When the desired depth is reached, the high pressure valve 37 is closed and the low pressure valve 38 is opened to supply slurry material to the void below the beam 11 and fin 14 as the beam is extracted by winding up the hoist line 22 on the drum 23.

Before the beam is completely extracted a marker rod is stuck in the ground to mark the location of the front flange 14 of the beam. After the beam is extracted, the low pressure valve 38 is closed and the jack cylinder 77 is retracted to raise up the stabilizing pad 70. The crane 12 is then moved (to the left as seen in FIG. 1) until the beam overlaps the marker rod by the desired amount. As an example, for a beam 11 having an external flange to flange dimension of 30 inches and a rearwardly projecting fin of 14 inches, it has been found that good results are obtained if the rear flange 15 overlaps the space previously occupied by the front flange 14 by about 4 inches. The fin 41, of course, extends rearwardly another 14 inches and thus substantially penetrates the slurry material injected below the web 16 during the previous extraction. This overlapping plus the cooperation of the fin 41 and the rearwardly directed supply nozzle 45 have been found to result in the formation of a slurry wall having substantially uniform wall thickness with lateral reinforcements formed by slurry material occupying the space left below the rear flange 15 located approximately every 26 inches along the length of the wall. The slurry material initially left in the space below the front flange 14 is largely dissipated or merged into the space below the rear flange 15 during the next succeeding insertion and extraction.

It will be appreciated, of course, that once the amount of overlap is set, the beam is again adjusted for plumbness and the stabilizer is set, as described above in connection with the initial insertion, before the next insertion and extraction are made, and the process is repeated again and again until the desired length of wall is completed. Preferably, the composition of the slurry material is such that it does not completely harden but rather sets to a consistency much like fresh window glazing putty.

I claim as my invention:

1. Apparatus for building below ground slurry walls comprising, in combination, a beam for making successive overlapping insertions into and extractions out of the ground along a line of travel, means for substantially vertically aligning said beam and for vibrating said beam during successive insertions and extractions, said beam having a substantially I-beam cross section with front and rear transverse flanges and a central web disposed substantially along said line of travel, said beam having a rigid fin adjacent the lower end thereof projecting rearwardly therefrom along said line of travel a substantial distance into the previous insertion to prevent necking down of the previously formed wall portion, and supply nozzle means adjacent the lower end of said beam including one nozzle located adjacent said fin and having a substantially rearwardly directed orifice and a second nozzle located forwardly thereof on the beam end and having at least one discharge orifice disposed substantially parallel to the beam web for injecting slurry material into the void in the ground beneath the beam and fin as the beam is extracted.

2. Apparatus as defined in claim 1 including jet nozzle means adjacent the lower leading edge of said beam for injecting slurry material into the ground during beam insertion.

3. Apparatus as defined in claim 2 including high pressure pump means for supplying slurry material to said jet nozzle means during beam insertion.

4. Apparatus as defined in claim 3 including separate pump means for supplying slurry material to said supply nozzle means.

5. Apparatus for building below ground slurry walls comprising, a lift crane having a frame, a boom and a hoist line, a guide pivotally connected to said boom adjacent the tip thereof for swinging movement about two substantially perpendicular horizontal axes, a beam slidably mounted on said guide for vertical movement, means mounted on said guide and suspended by said hoist line for vibrating said beam in a substantially vertical direction, said vibrating means being connected to the upper end of said beam, adjustment means interconnecting said frame and the lower end of said guide for vertically aligning said guide and beam by pivoting said guide on said axes, means including a vertically adjustable stabilizer pad for selectively supporting the lower end of said guide, means including a jet nozzle adjacent the lower leading edge of said beam for injecting slurry material into the ground during beam insertion, and means including at least one supply nozzle for injecting slurry material into the ground below the beam during beam extraction.

6. Apparatus as defined in claim 5 wherein said beam is of substantially I-beam configuration in cross section and has a rigid fin adjacent the lower end thereof projecting rearwardly therefrom along the direction of travel.

7. Apparatus as defined in claim 6 including a roller assembly adjacent the lower end of said guide and having a plurality of rollers for engaging and guiding the face, sides and back of the front flange of the I-beam.

8. Apparatus as defined in claim 5 wherein said adjustment means includes longitudinally telescopic elements interconnecting said crane frame and a transverse element, a sub-frame connected to the lower end of said guide and slidably mounted on said transverse element and means for extending and retracting said telescopic elements and for laterally sliding said sub-frame.

9. Apparatus as defined in claim 5 including a trailer drawn by said crane, said trailer supporting slurry supply and pump means connected by conduits to said jet nozzle and said supply nozzle.

10. A method of constructing a fluid impervious subterranean wall which comprises vertically sinking a web member into the ground by applying to the web member a vertically vibratory force, then extracting the web member from the ground while applying a vertically vibratory force thereto, concurrently injecting under pressure into the ground beneath the lower edge of the web member as it is sunk and extracted a liquid settable grout, the vibratory sinking and extraction of the web member loosening the soil surrounding the space occupied by the web member as it is sunk and extracted, and the grout filling the space left by the web member as it is being extracted and also during sinking and extraction filling voids vitratorily developed in the ground surrounding such space so as to substantially transversely enlarge the grout-filled volume at and around the vibratorily sunk and withdrawn web member beyond the aforesaid space, and thereafter successively sinking and extracting said web member in the ground alongside the grout-filled space left by the preceding sunk and extracted web member, and in overlapping relationship thereto, while injecting grout under pressure beneath the lower edge of the web member, before the grout in the previously grout-filled space has set wherein the web member includes a central web, longitudinal flanges at the longitudinal edges of the central web and at least one spur at least one longitudinal edge of the central web, the base of the spur being located at the associated flange, said spur extending outwardly away from the associated flange and being coplanar with the central web, and the overlapping is such that a flange on the web member being sunk is disposed between the grout-filled spaces left by the flanges on the web member last extracted.

11. The method defined in claim 10 for building below ground slurry walls utilizing a single vibratory beam having a rearwardly projecting fin and nozzle means on the lower end thereof including the steps of: (a) vertically aligning the beam; (b) vibrating the beam into the ground to the desired depth; (c) injecting slurry material through the nozzle means into the void left in the ground as the beam is vibrated and extracted; (d) advancing the beam along a line of travel to a position where the fin substantially overlaps the web of slurry material left in the ground after the previous extraction; and, (e) repeating steps (a) through (d) to form a continuous wall segment.

12. The method defined in claim 11 wherein the beam is slidably supported on a guide and including the step of stabilizing the guide on the ground during steps (b) and (c).

13. The method defined in claim 11 including the step of injecting slurry material through the nozzle means during step (b).

14. The method defined in claim 11 wherein the nozzle means includes at least one downwardly directed orifice and at least one rearwardly directed orifice and including the steps of injecting slurry material at high pressure through the downwardly directed orifice during step (b) and injecting slurry material through the rearwardly directed orifice during step (c).

15. A method of constructing a fluid impervious subterranean wall which comprises vertically sinking a web member into the ground by applying to the web member a vertically vibratory force, then extracting the web member from the ground while applying a vertically vibratory force thereto, concurrently injecting under pressure into the ground beneath the lower edge of the web member as it is sunk and extracted a liquid settable grout, the vibratory sinking and extraction of the web member loosening the soil surrounding the space occupied by the web member as it is sunk and extracted, and the grout filling the space left by the web member as it is being extracted and also during sinking and extraction filling voids vibratorily developed in the ground surrounding such space so as to substantially transversely enlarge the grout-filled volume at and around the vibratorily sunk and withdrawn web member beyond the aforesaid space, and thereafter successively sinking and extracting said web member in the ground alongside the grout-filled space left by the preceding sunk and extracted web member, and in overlapping relationship thereto, while injecting grout under pressure beneath the lower edge of the web member, before the grout in the previously grout-filled space has set, wherein the web member includes a central web, longitudinal flanges at the longitudinal edges of the central web and at least one spur at at least one longitudinal edge of the central web, the base of the spur being located at the associated flange, said spur extending outwardly away from the associated flange and being coplanar with the central web and the overlapping is such that a flange on the web member being sunk is disposed substantially in the adjacent grout-filled space left by a flange on the web member last extracted.

* * * * *